United States Patent [19]

Lichtenstein

[11] 4,416,596

[45] Nov. 22, 1983

[54] FLUID-TRANSFER SYSTEM AND METHOD

[76] Inventor: Eric S. Lichtenstein, 420 Taconic Rd., Greenwich, Conn. 06830

[21] Appl. No.: 252,706

[22] Filed: Apr. 9, 1981

[51] Int. Cl.[3] ..... F04B 7/04

[52] U.S. Cl. ..... 417/488; 417/498; 417/502; 417/503; 222/137

[58] Field of Search ..... 417/488, 498, 493, 503, 417/502; 222/136, 137, 144.5

[56] References Cited

U.S. PATENT DOCUMENTS

| | | | |
|---|---|---|---|
| 2,447,686 | 8/1948 | Crittenden | 417/505 X |
| 3,291,347 | 12/1966 | Blades | 222/136 |
| 3,302,578 | 2/1967 | Anderson | 417/488 |
| 3,464,359 | 9/1969 | King et al. | 417/488 X |
| 3,493,149 | 2/1970 | Cosner et al. | 222/361 X |
| 3,521,793 | 7/1970 | McShirley | 222/216 |
| 3,649,204 | 3/1972 | Farr | 417/488 X |
| 3,669,358 | 6/1972 | Waldman | 222/129 |
| 3,695,788 | 10/1972 | Loomans | 417/488 |
| 3,837,378 | 9/1974 | Kanki et al. | 417/488 X |
| 4,136,708 | 1/1979 | Cosentino et al. | 417/503 |
| 4,150,759 | 4/1979 | Bell, Jr. | 222/137 X |

*Primary Examiner*—Leonard E. Smith

*Attorney, Agent, or Firm*—Blum, Kaplan, Friedman, Silberman & Beran

[57] ABSTRACT

A fluid-transfer system has two pistons movable within a barrel so that the ends of the piston faces can move together or apart, the barrel having at least two openings therein for transfer of fluid into and out of said barrel. The pistons can be controlled manually, mechanically or by computer to draw fluid from one or more reservoirs into the barrel and transfer the selected fluid in selected quantity into a chamber for storage or for reaction or analysis. The system is particularly useful for transfer of fluid from a selected chamber to another selected chamber, for mixing fluids, and for carrying out multiple tests on blood taken from a patient or from a plurality of patients under the control of a computer, which can accept programs for carrying out specific procedures.

23 Claims, 21 Drawing Figures

FLUID-TRANSFER SYSTEM AND METHOD

BACKGROUND OF THE INVENTION

Transfer of fluid from one vessel to another is an essential step in an extremely large number of operations both in commerce and in the laboratory. Pumps of a wide variety of types have been devised for carrying out the step at an appropriate rate, but, in general, the achievable precision desired for the transfer has not been completely satisfactory. Various valveless positive displacement pump systems have been developed to provide precision pumping, but such systems have not been completely suitable for automatic and random access. More specifically, it has not been possible to draw fluid automatically from a selected vessel and transfer the fluid in selected quantities to another selected vessel. Particularly, it has not been possible to carry out automatic transfer from one selected vessel to another selected vessel where a plurality of vessels are connected with the system and to carry out the transfer at low cost. Systems permitting choices between fluid sources lose precision or waste significant amounts of fluids they are mixing.

A particularly important case is the testing of blood samples which may be necessary in the office of a physician, at the bedside of a patient in a hospital or in the laboratory of a hospital where blood tests are carried out on a large scale for a number of patients. The number of blood tests, in particular, being carried out on a routine basis in hospitals is still expanding. Consequently, it has become necessary to devote a substantial fraction of the labor available in a hospital to this task. Also, the number of tests carried out is so large that there is serious danger of an intolerable increase in errors.

The physician practicing by himself illustrates the need for a relatively simple system which can carry out tests on blood or other fluids automatically and rapidly, so that the physician need not wait for the return of a report from an outside laboratory. In general, the report cannot be received quickly enough so that the patient can remain in the doctor's office. It would be highly desirable to have available a device which would carry out the required tests on the physician's premises so that the test results would become available in a few minutes, and generally, without the need for a technician to carry out the tests. As another example, hospitals now routinely take blood samples from each patient on admission and carry out a number of routine tests as well as any special tests which may be specified by a physician. The staff required to carry out such tests as the laboratories are now organized can be quite substantial. Again, it would be advantageous if routine tests, at least, could be carried out automatically and, of course, even more advantageous if the special tests could be carried out automatically. Another advantage would be the selection and improved availability of tests with limited staff and resources.

The present invention is designed to provide precision pumping as to quantity, choice among vessels from which fluid is to be drawn, choice among vessels to which fluid is to be transferred and with minimal waste. It is also intended to significantly improve the cost-effectiveness of various kinds of devices requiring precision and selectivity in fluid transfer by reducing the requirements for electromechanical subsystem components. The system can be placed under the control of a microprocessor or microcomputer for completely automatic transfer of fluid. The interconnections between inlet and outlet ports, in combination with computer programmed fluid pumping, can perform complex sequences of fluid processing.

SUMMARY OF THE INVENTION

According to the present invention, two pistons are fitted in a barrel so that the opposed piston faces can move together or apart. The barrel has at least two openings therein, each connectable with a different fluid path such as a vessel or tube. The pistons are long enough so that the interior faces thereof can be brought together when in registry with any of the openings in the barrel. The interior faces of the pistons mate so that when they are brought together, virtually all liquid is displaced from therebetween. In general, the interior face ends of the pistons will be transverse to the axis of the barrel.

Separating the pistons by drawing either one or the other of the pistons away from the openings with which they are in registry will result in drawing fluid from the vessel connected to the opening. The pistons are drawn apart through a distance corresponding to the quantity of liquid desired to be transferred. Holding the pistons the same distance apart, they are then moved toward another of the openings into the barrel. This closes the inlet opening since one of the piston bodies blocks the inlet opening. Moving the pistons together while the space therebetween is in registry with a second opening results in transfer of the fluid drawn from the first vessel through the opening connected to the second vessel.

In a preferred embodiment, the number of openings into the barrel is at least three so that it becomes possible to draw fluid from one of a plurality of first vessels and to deliver it to another of a plurality of second vessels. Moreover, drawing fluid from two or more vessels and transferring the two fluids to a third vessel makes it possible to mix fluids in a closely controlled ratio and to carry out reactions.

Preferably, the vessel in which a reaction is carried out is transparent, so that light can be transmitted therethrough to be received by sensors. The light transmitted through the vessel is received by a sensor and signaling means are connected therewith for transmitting the information to a display, or, preferably, a computer for yielding information as to the course of the reaction and the results thereof. The sensors can include photomultipliers, nephelometers, fluorometers or any other sensing device for measuring the intensity or wavelength of the light transmitted through the reaction chamber. Alternatively, the outlet passage may be fitted with other types of sensors to measure physio-chemical characteristics or constituents of the fluid. The sensors may include, for example, ion-specific or other electrodes for measuring conductivity or capacitance.

The system may be operated manually but preferably the movement of the pistons in the barrel is controlled by a computer which operates two motor drives, which in turn control the sequence of positionings of the pistons. To transfer fluid from a reservoir, the inner ends of the pistons are brought together at an opening in the barrel which connects with a reservoir containing the fluid to be transferred. One of the pistons is then moved outwardly, that is, away from the other piston, to draw such fluid from the reservoir into the space formed between the pistons. The aliquot is transferred along the barrel by movement of both pistons until the opening to a selected reaction chamber is reached, at which point, one the pistons is moved toward the other until the aliquot has been forced into the reaction chamber. The transfer into the reaction chamber can be carried out with sufficient force so that successive transfers of different fluids into one reaction chamber will result in mixing of the fluids.

In a preferred form, the reservoirs, the barrel and the reaction chambers are molded in a module or synthetic resin, such as plastic. The synthetic resin is preferably resistant to wetting by water. The openings into the reservoirs from the barrel are tapered so that the lower meniscus of the fluid in the reservoir will withdraw from the opening, as a result of which, contamination of the liquid between the pistons during transfer of the fluid within the barrel can be avoided.

In a preferred form of the module, the number of reservoirs is at least three, and at least two of the reservoirs are interconnected so that filling of one reservoir will simultaneously fill a connected reservoir. Also, openings are provided in the module for introduction of fluid into the reservoirs. In another embodiment, access to at least one of the reaction chambers for a substance-specific electrode is provided.

The two pistons and the interior of the barrel may be cylindrical with a close fit between the pistons and the barrel so as to minimize contamination of the interior of the barrel as the pistons are moved. In another embodiment, the pistons are threaded into the barrel, using a type of thread which will further minimize movement of liquid between the exterior of the pistons and the interior of the barrel.

As a further provision against leakage of liquid from a reservoir into the barrel, the openings connecting each reservoir to the barrel may have a valve therein which closes the opening until such time as the end of a piston comes into registry therewith and moves the valve into open position.

Accordingly, an object of the present invention is to provide a system for transferring a selected fluid in precise quantity from one vessel to another, the system including a valve fitted with two pistons entering the value so that the piston faces are opposed in the barrel and openings in the barrel connecting with each of the vessels.

A further object of the present invention is to provide a system for transferring a selected fluid in precise quantities from a selected vessel to another selected vessel when the number of vessels is at least two.

Yet a further object of the present invention is to provide a system for automatically transferring a selected fluid in precise quantity from one vessel to another under the control of a programmable computer, the system including a valve fitted with two pistons entering same so that the piston faces are opposed in the barrel and openings in the barrel connect with each of the vessels.

Another object of the present invention is to provide a combination of reservoirs and at least one reaction chamber in a module which can be introduced into a system for automatically positioning and sequencing two pistons introduced into opposite ends of the barrel for transferring fluid from said reservoirs to said reaction chamber.

An important object of the present invention is a system for automatically transferring fluid from reservoirs to a reaction chamber while minimizing contamination.

Still another object of the present invention is a method of transferring fluid from reservoirs to a reaction chamber automatically by controlling the positioning and sequencing of two pistons in a barrel, said contolling being carried out by a programmable computer.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1A, 1B, 2A, 2B, 2C, 2D, 2E, 2F, 2G, 3A, 3B, 3C, 3D:
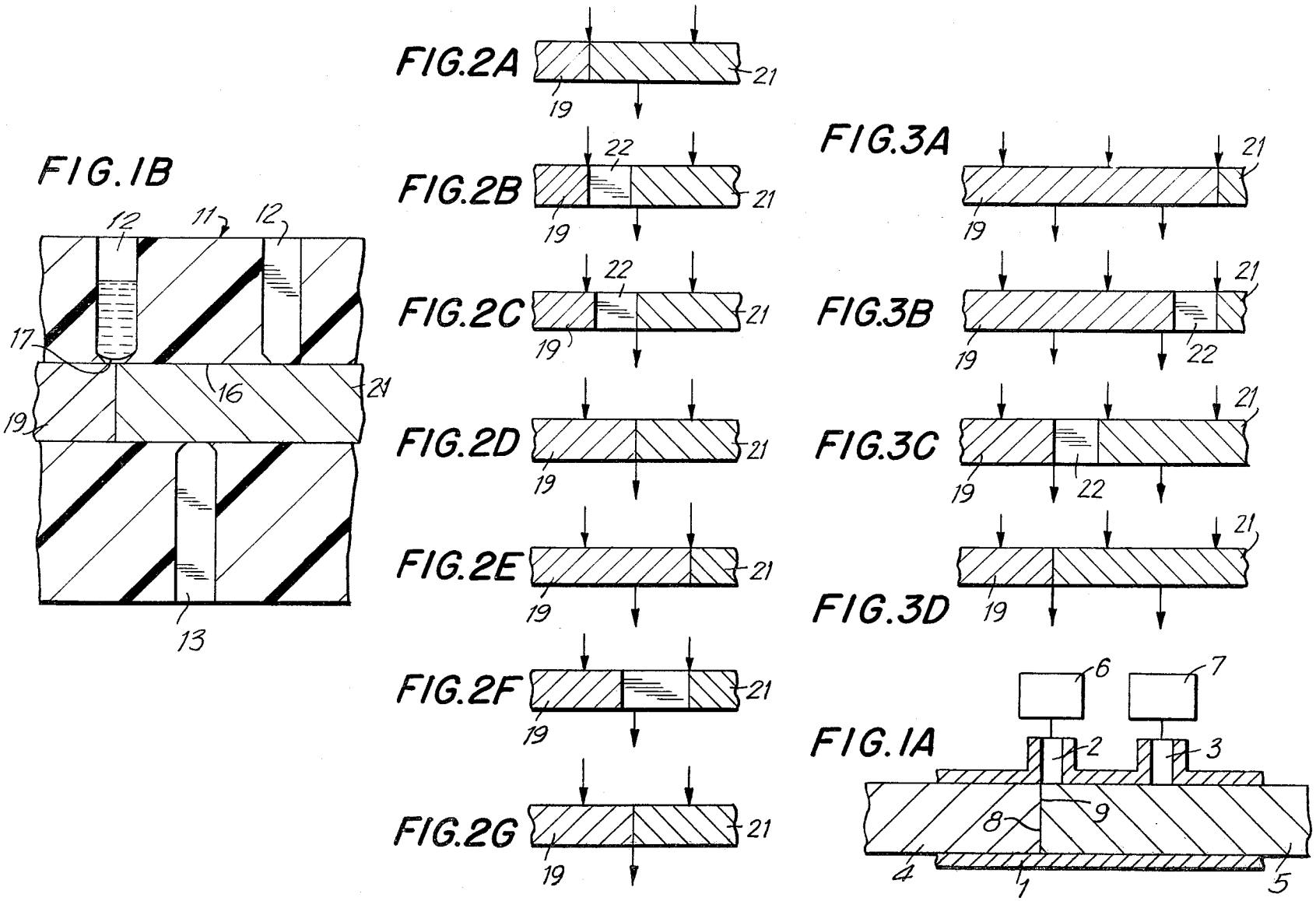
FIG. 1A is an elevational, partial-sectional view of a barrel having openings therein for connection with at least two vessels.
FIG. 1B is an elevational, partial-sectional view of a module in accordance with the present invention.
FIGS. 2A through 2G illustrate the sequence of positionings for the two pistons in a barrel for the transfer of fluid from two reservoirs to a single reaction chamber.
FIGS. 3A through 3D illustrate the transfer of fluid in a system having three reservoirs and two reaction chambers.

FIG. 1A illustrates the basic embodiment of the present invention, said Fig. showing in partial-sectional view a barrel 1 having openings 2 and 3 therein. Barrel 1 is fitted with pistons 4 and 5, said pistons fitting the barrel closely. Vessels 6 and 7 are connectable respectively through openings 2 and 3, indicated schematically.

Pistons 4 and 5 have closed end faces 8 and 9, respectively, said faces fitting closely together so that when exposed as shown in said Fig., little if any fluid can flow between the closed faces.

Moving said closed end faces apart, whether manually or automatically under the control of a computer, results in fluid being drawn from vessel 6 into the space between the closed ends. The liquid specimen drawn may be referred to as an aliquot. Now, maintaining the distance between closed ends 8 and 9 at a selected value, both of the pistons are moved toward the right until the space therebetween comes into registry with opening 3 in barrel 1. Bringing the closed ends together while keeping the space between the closed ends in registry with opening 3 transfers the aliquot to vessel 7. These steps may be repeated as often as desired for transferring as large a quantity of fluid as desired from one vessel to the other.

Connection from openings in barrel 1 to corresponding vessels may be made by means of flexible tubing, piping or any other suitable method. Connections between an opening and a vessel may be changed so that an opening is connected with a different vessel, such a method or operation being appropriate where the system is to be used for transfer of fluids on a commercial scale as would be the case, say, in a tank farm. Preferably, however, the barrel is integral with two or more vessels, such an arrangement being particularly appropriate where small quantities of liquids are to be transferred and analyzed. Such a construction is termed a module. The module will have a spatial design in which the positions of the openings in the barrel have fixed distance relationships. The characteristics of the module can be represented by mathematical relationships in a computer's operational programming. In the partial sectional view of FIG. 1B, a portion of a module indicated generally by the reference numeral 11 has therein two reservoirs 12 for containing one or more fluids and a reaction chamber 13. Each of the reservoirs 12 has a bottom opening 17 connecting with barrel 16. Preferably, openings 17 are tapered as shown in FIG. 1B, and the module is of a synthetic resin which resists wetting by aqueous fluid. As a result, the meniscus of a fluid in the reservoir tends to pull away from opening 17. This is desirable, since it helps to avoid contamination of fluid being transferred in barrel 16. Barrel 16 is fitted with two pistons 19 and 21 each having closed interior ends, the positionings of which in barrel 16 can be accurately controlled.

The method by which fluid is transferred from a reservoir to a reaction chamber is shown schematically in FIGS. 2A through 2G which show the inner ends of two pistons in a barrel, the arrows above the barrel representing reservoirs, and the arrow below the barrel representing a reaction chamber. In FIG. 2A, pistons 19 and 21 have been brought into contact with each other in registry with the arrow representing the left-hand reservoir. Piston 21 is then moved toward the right, that is, away from the other piston, as shown in FIG. 2B. An aliquot of liquid is drawn into space 22 between the inner ends of the pistons. The quantity of liquid withdraw from the left reservoir will be equal to the internal cross-section of the barrel multiplied by the distance between the two piston faces or ends. This volume determination is accurate and therefore programable in a computer. As depicted in FIG. 2C, the distance 22 between pistons 19 and 21 is kept constant and the pistons are moved toward the right. This movement is stopped when the aliquot of liquid comes into registry with the outlet to a reaction chamber indicated by the arrow beneath the barrel. Left-hand piston 19 is then moved toward piston 21, as shown in FIG. 2D to force the fluid into the reaction chamber. The liquid can be forced into the reaction chamber even when the chamber is not vented and can be directed thereinto with sufficient force so that it will mix with any other fluid in the chamber.

To draw fluid from the right-hand reservoir, the two pistons are moved in contact with each other until the interface between the pistons comes into registry with the right-hand reservoir as shown in FIG. 2E. The sequence of piston movements can then be reversed. Alternatively, as shown in FIG. 2F, piston 19 is moved toward the left to draw out from the right-hand reservoir an aliquot which may be so large that piston 19 travels past the opening to the lower reaction chamber. However, piston 19 should not be drawn far enough to the left so that it can draw liquid from the left-hand reservoir. Finally, as shown in FIG. 2G, pistons 19 and 21 are moved toward each other until they make contact in registry with the opening to the reaction chamber, thereby completing the transfer of two fluids from different reservoirs to a single reaction chamber. If the quantity to be transferred is larger than can be transferred in a single operation under the restriction that liquid must not be drawn from two reservoirs simultaneously, the operation of drawing from one reservoir and transferring to one reaction chamber can be repeated until the desired quantity of liquid has been moved. Similarly, fluids from two reservoirs can be drawn in the barrel in sequence, prior to outlet to facilitate mixing.

FIGS. 3A through 3D illustrate the case where there are three reservoirs from which different fluids can be drawn and two reaction chambers into one of which it is desired to transfer liquid. As shown in FIG. 3A, pistons 19 and 21 are in contact with each other, and the interface therebetween is in registry with the right-hand reservoir. FIG. 3B illustrates the drawing of aliquot 22 by movement of piston 19 to the left. FIG. 3C shows the movement of the aliquot to a position from which it can be transferred into the left-hand reaction chamber by simultaneous movement of pistons 19 and 21 to the left, keeping the distance between the pistons constant. Finally, as shown in FIG. 3D, movement of piston 21 toward piston 19 forces the fluid from the barrel into the left-hand reaction chambers. The reaction chambers may be vented. Without venting, there is no tendency for the liquid to flow into the right-hand reaction chamber during the transfer of aliquot 22 across the opening from the barrel into the right-hand reaction chamber. This feature of the construction, as well as the fact that the openings into the reservoirs are tapered, minimizes the danger of serious contamination. It is, however, desirable, in this opposed piston configuration, that the openings for inlet to outlet from the barrel be staggered along the barrel.

Further, it is possible to provide reservoirs containing a diluent or distilled water so that movement of a capsule of water along the barrel can clean the barrel of any remains from a previous transfer, should the precise motion of said pistons in concert not sufficiently limit flow of liquids from contaminating residue.

Figure 9:
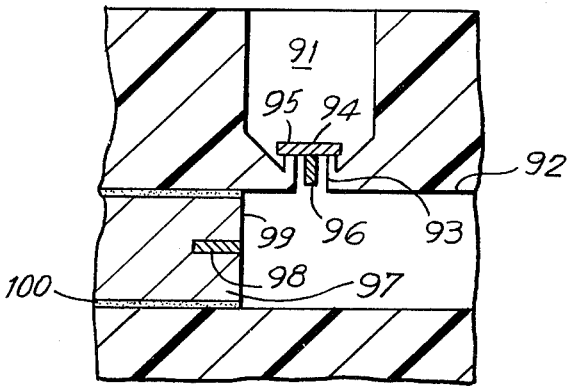
FIG. 9 is a sectional view of a barrel with openings therein fitted with valves.
Figure 10:
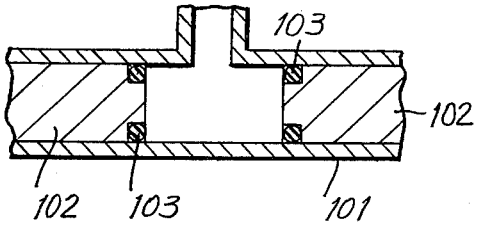
FIG. 10 is a sectional view through a barrel and pistons therein in which the interior end of each piston is fitted with a washer.

Another embodiment which minimizes residual liquid along the interior of the barrel is shown in FIG. 10. Barrel 101 is fitted with pistons 102, each of which has a soft washer 103 fitting in a channel at the interior end of the piston. The washer, preferably of resilient plastic material, wipes the interior of the barrel clean. Sealing may also be achieved by the use of appropriately placed O-rings or silicone or other insoluble grease between the cylindrical exterior of the piston and the interior of the barrel. FIG. 9 shows a layer of grease 100 between piston 97 and the barrel.

Figure 4:
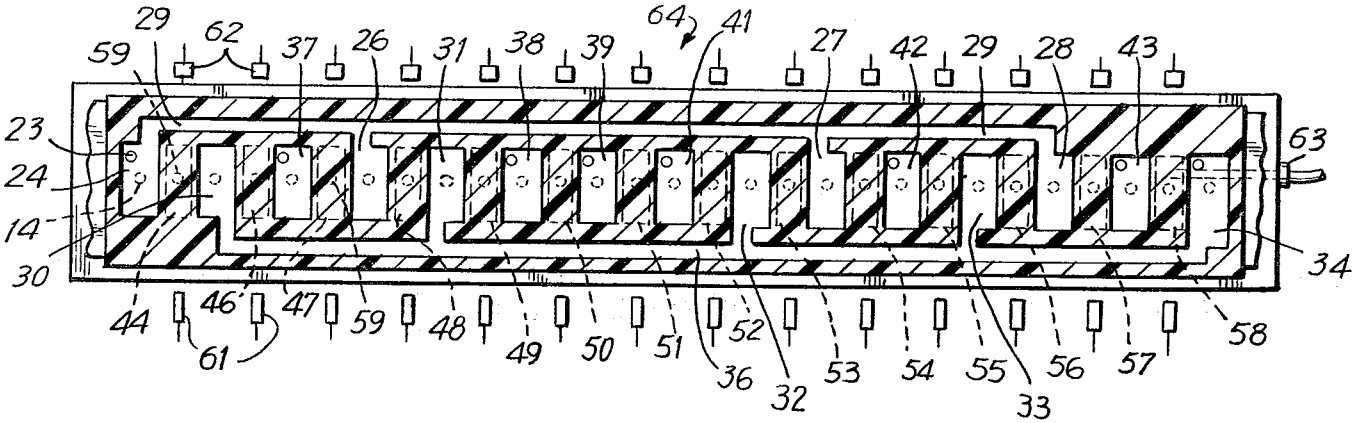
FIG. 4 is a top plan view in section of the arrangement of reservoirs and interconnecting channels in a module.

As aforenoted, reservoirs may be interconnected so that a plurality of reservoirs can be filled simultaneously by the introduction of fluid through a single opening, as shown in FIG. 4, the module being generally indicated as 64. Similarly, a fluid or mixture in the barrel can be pumped to an outlet passage connected with one or more reservoirs, thus allowing convenient distribution of fluids for meeting the requirements of multiple procedures. Thus, for instance, a serum sample may be introduced through opening 23 into reservoir 24. Reservoirs 24, 25, 27 and 28 are interconnected by channel 29, so that all of these reservoirs can be filled through opening 23. Similarly, reservoirs 30, 31, 32, 33 and 34 are all interconnected by channel 36.

For the purpose of describing how multiple tests are carried out, it may be assumed that reservoirs 24, 26, 27 and 28 contain a serum taken from a single patient, reservoirs 30 through 34 contain a diluent, and individual reservoirs 37, 38, 39, 41, 42 and 43 contain specific reagents for carrying out selected tests on the serum.

Moreover, module 64 may be designed and constructed to be suitable for carrying out a specific series of fluid transfers as would be the case where a specific series of blood tests is to be carried out. In such case, module 64 may be keyed to program a computer for eliciting the corresponding commands. Then, using the two pistons as described above, aliquots are taken from reservoirs 24, 30 and 37 and transferred through an opening 59 into one of the reaction chambers 44 or 46, shown in phantom. The transfer of the last two fluids is carried out with sufficient force to cause mixing in the chamber. One of the light emitters 61 projects a beam of light toward a corresponding light sensor and signaling means 62, the latter being connected with a computer (FIG. 5).

A second test is carried out using the fluids in reservoirs 26, 31, 38 and 39, these containing respectively serum, diluent and two reagents. The reaction can conveniently be carried out in any of the reaction chambers 48 through 50. A third test can be carried out using the reservoirs 41, 32 and 27, the first reservoir containing a test reagent, the second, diluent, and the third, serum. The reaction can conveniently take place in reaction chamber 52 or 53. Reservoir 27 can deliver a second aliquot for reaction with test reagent in reservoir 42 and diluent in reservoir 33, the reaction to be carried out in either of the reaction chambers 54 or 55, and finally, aliquots can be drawn from serum reservoir 38, test reagent reservoir 43 and diluent reservoir 34 for reaction in either chamber 57 or 58. FIG. 4 also shows a substance-specific electrode 63 making contact with the fluid in reaction chamber 58 for determining the presence of a specific substance or ion. Similarly, other sensors of physical and electrical characteristics of the fluid mixtures can be brought into functional proximity with reaction or sample fluid to provide signals appropriate to indicating the required information concerning the status or course of a procedure.

Figure 5:
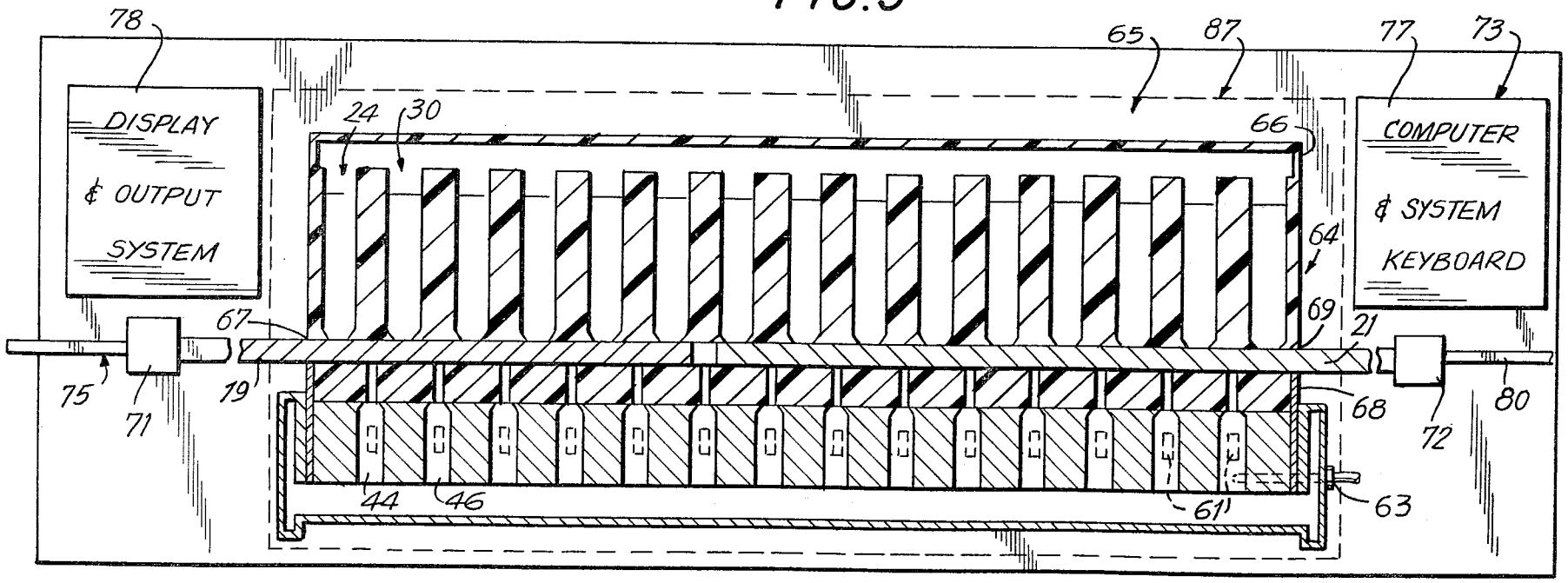
FIG. 5 is a front elevational view in section of a module in accordance with the present invention.

FIG. 5 is a front view of a module indicated by the reference numeral 64 corresponding to FIG. 4. The module has an upper section 66 containing reservoirs 24 and 30, for example, therein and a lower section 68 having reaction chambers, for example, 44 and 46 therein. The barrel is defined intermediate upper section 66 and lower section 68 and is integral therewith, the preferred method of manufacture being molding of a synthetic resin. Pistons 19 and 21 are inserted into module 64 through open ends 67 and 69. Pistons 19 and 21 are moved by piston drive assemblies 71 and 72 along piston drive tracks 75 and 80.

Housing 65 has a door 87 through which the module 66 is inserted. Housing 65 also contains a computer 73 mounted on electronics boards. Keyboard 77 of computer 73 is accessible at the front of housing 65. Also visible at the front of the housing is a display and output system 78.

Figure 6:
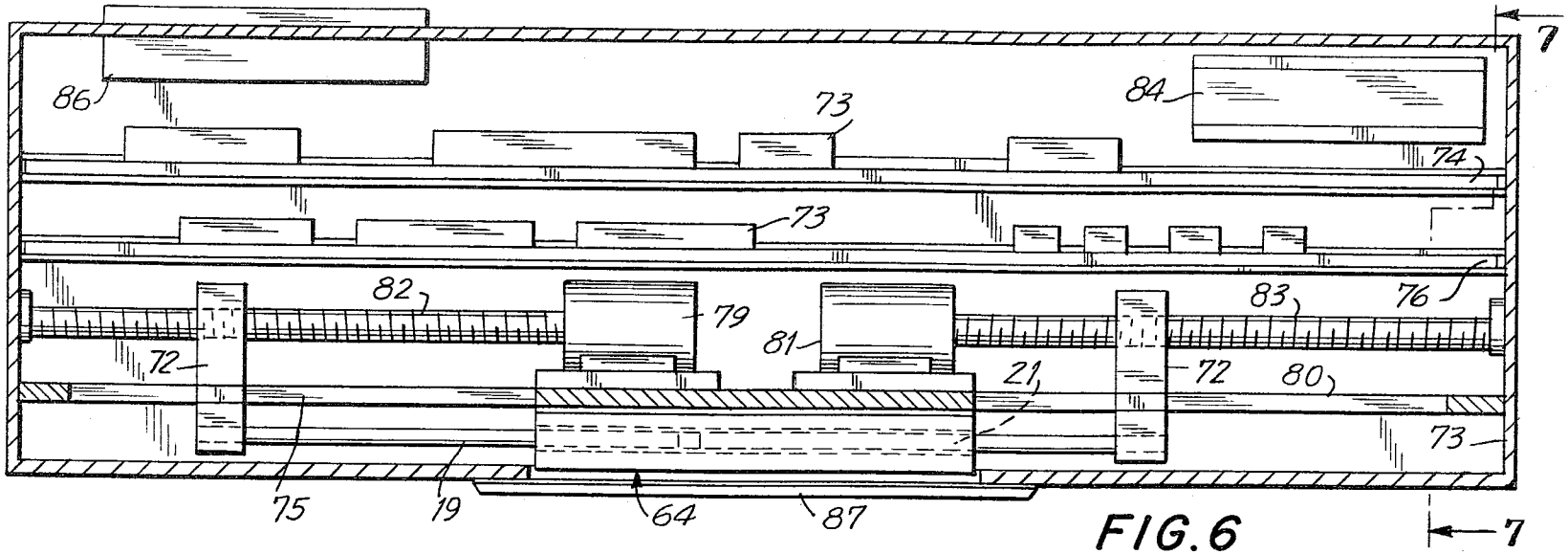
FIG. 6 is a cut-away plan view of a system in accordance with the present invention.

The method of drive is more clearly seen in FIG. 6, which shows computer-controlled stepping motors 79 and 81, which rotate precision screws 82 and 83, thereby moving the drive assemblies 72, to which are attached pistons 19 and 21. Assemblies 72 ride on piston drive tracks 75 and 80. The system is powered through power supply 84, and the temperature of the system is controlled by means of temperature control system 86. Preferably, the temperature control system is set to hold the housing and the contents thereof at 37° C., since this is the temperature at which blood tests and reactions can be conveniently carried out.

Figure 7:
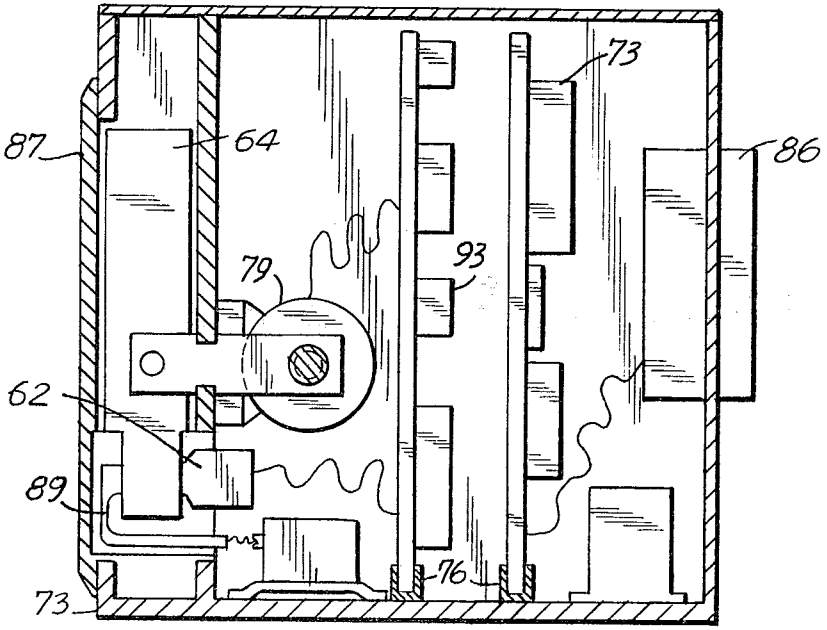
FIG. 7 is a sectional view taken along lines 7—7 of FIG. 6.

FIG. 7 is a partially cut-away end view of the system. Module 64 is inserted into housing 65 through access door 87. Preferably, the mode of insertion is similar to that of a cassette into a cassette player, and the system is constructed so that the door may be closed and the system then set into operation. The computer is mounted on computer boards 76 using the standard electronics edge pin connector system.

The preferred method of determining the results of the reactions carried out in the reaction chambers employs a fiber optic spectrophotometer system which transmits light into fiber optics 89, which, in turn, are oriented and disposed for transmitting light through the individual reaction chambers 44 through 58, as shown in FIG. 4. Light-sensing means 62 receives the transmitted light from the reaction chambers and transmits appropriate signals to computer 73, computer 73 being constructed and programmed for interpreting the information provided from sensing means 62. As aforenoted, the sensing means may include a photomultiplier, a nephelometer, a spectrometer, fluorometer or any other appropriate means for signaling the computer as to the intensity and the nature of the light transmitted through the reaction chamber.

Figure 8:
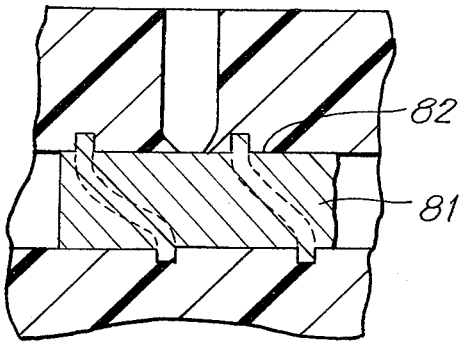
FIG. 8 is a sectional view of a threaded piston within a threaded barrel in accordance with the present invention.

As aforenoted, the pistons are constructed so that they have a sliding fit with the barrel and it is this sliding fit that minimizes the amount of contamination of the barrel itself and of the fluid next to be transferred. FIG. 8 shows another embodiment of the invention in which the quantity of contaminant remaining in the barrel is further minimized. In this case, piston 81 is threaded so that it mates slidingly with barrel 82. For this construction, it is necessary that the drive motors be so arranged that rotation as well as linear transfer will be possible.

In yet another embodiment of the invention as depicted in FIG. 9, reservoir 91 is connected to barrel 92 through opeing 93. Opening 91 is closed with a valve 94 comprising a closure element 95 and magnet 96. Piston 97 also has therein magnet 98 close to the periphery of the piston. To open valve 94, piston end 99 is brought into registry with opening 93 by movement toward the right, as shown in FIG. 9. Then, piston 97 is rotated to bring magnet 98 into registry with magnet 96. These magnets are so disposed that the portions in registry are of like polarity, causing valve 94 to be moved upwardly, thereby permitting flow of fluid from reservoir 91. Further rotation of piston 97 permits valve 94 to drop into place, closing reservoir 91. Piston 97 is then moved along barrel 92 to a selected outlet (not shown). This outlet may likewise be fitted with the same type of valve if desired.

It will be noted that the sequence of steps delineated for opening and closing a valve requires that the piston be rotatable as well as translatable . Constructions for carrying out the two types of movement under precise control is well known. For example, a piston within an outer piston which can rotate to register the barrel inlets and outlets can be used. It is not necessary to have all outlet-reaction chambers as shown, but this is convenient for systems for maximum flexibility.

It should be noted that the present invention is not to be considered as restricted to relatively small systems dedicated only to carrying out analytical reactions on fluid samples such as blood serum. The system is adaptable for transferring fluids in intermediate or in large quantities, it being necessary only to provide, in appropriate materials, chambers and reservoirs of appropriate size and drive pistons of appropriate size. Nevertheless, particular attention in the present application is devoted to the relatively small integral unit such as is shown in FIGS. 4 through 7 because of the fact that it is particularly adaptable to rapid automatic analysis of serum samples and to carrying out these tests in locations such as at a bedside and in a physician's office. Further to this particular use of the invention, modules can be constructed for mass production so that they are relatively low in cost and are thus disposable. The modules can be prepared wih both diluent and specific test reagents for carrying out specific tests, in which case, the tops of the reservoirs containing the diluents and reagents are sealed, as with removable pressure-sensitive tape. It then becomes necessary only to insert the test sample into one of the reservoirs, the reservoir being connected with the other test sample reservoirs for distribution to appropriate inlets. These modules can be designed for carrying out several tests on the serum of a single patient or for carrying out one or more tests on several patients by variation in the reservoir patterns and associated programming. Moreover, the system is adaptable to running tests on several modules simultaneously, it being necessary only to provide the necessary drive units for the two pistons for each module. Preferably disposable, the modules may be cleaned out and sterilized for reuse. They may be used for matrix and for profile testing, in clinical chemistry, hematology and bacteriology.

Figure 11:
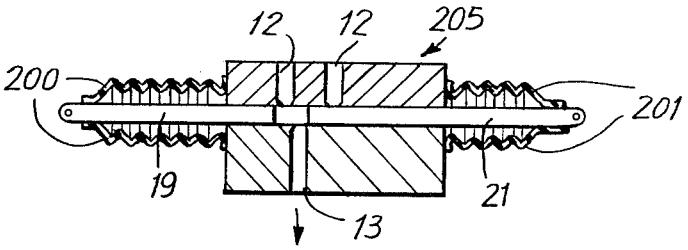
FIG. 11 is a sectional view of a barrel and piston arrangement constructed in accordance with an alternative embodiment of the invention.

As aforenoted, the fluid-transfer system of the present invention using a module is particularly suited for routine testing of serum and carrying out other hospital procedures. Examples of such procedures are the preparation and infusion of intravenous fluid, preparation of other physiologic fluids and administration of medication. The system is useful for computer assisted intensive care units facilitating selection and administration of a plurality of drugs on an extended, programmed schedule or according to sensed parameters. Such uses are facilitated by the fact that the two pistons in effect constitute a precision pump which can transfer any quantity of fluid by effecting a plurality of strokes. Cross-contamination is extremely small due to the fact that the pistons are made to have a sliding fit with the barrel and that the end faces of the pistons are preferably flat and precisely transverse to the direction of the barrel. Other procedures which can be carried out with the present invention are precision pumping of fluids and the measurement of their volumes. In addition, as depicted in FIG. 11, the incorporation of pistons 19 and 21 and sealing end bellows 200 and 201 in the construction of module 205 allows maintenance of internal sterility, making the system suitable for mixing concentrates and water to prepare physiologic solutions; and also for manipulating bacterial cultures to a matrix of growth media. The system is also convenient for nonmedical procedures such as the formulation of cosmetics, in which case, the fluids transferred may have suspended therein solids, so that the fluid transferred could more aptly be described as a slurry, and other industrial or consumer product applications.

In my copending U.S. patent application having the Ser. No. 34,539 and filed on Apr. 30, 1979, now U.S. Pat. No. 4,370,983 I have described programmed fluid manipulations which involve control of fluid and medication infusions as well as chemical analyses of fluid composition or constituents. These procedures are facilitated by the use of the present invention.

Where a module is to be used in patient care, for example, a selected module containing material for a profile of chemical assays on a patient's serum would be integrated with the remainder of the system. As is customary, a serum sample may be transferred by way of an inlet to a plurality of reservoirs by way of the openings to the sample distribution manifold. Next, activation of the computer-control system transfers appropriate aliquots of serum and reagent for each reaction in sequence to a selected reaction chamber. The readout devices, such as photomultipliers, spectrophotometers, fluorometers, nephelometers or substance-specific electrodes, then signal the readout of the course of the reaction to the computer for interpretation and recording if desired. The computer may transmit its findings to one or more remote computer systems within a hospital or industrial plant, for example, or to external computer systems via any of the electronic information transmission methodologies. This configuration of computer assisted process control system lends itself, therefore, to ancillary functions as a computer system terminal facilitating electronic information processing for patient care, service billing, procedure inventory and quality control to suggest a few examples. The system is cost-effective in its basic function.

The computer, or more correctly, microcomputer, includes an internal clock structure in combination with operational programming for sequencing fluid transfer and fluid mixing and can record the onset of a reaction as well as the course of the reaction. The computer can therefore follow the reaction after appropriate signal conditioning such as conversion from analog to digital.

It will thus be seen that the objects set forth above, among those made apparent from the preceding description, are efficiently attained, and since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A fluid-transfer system comprising a barrel having an axis and having first and second open ends, first and second pistons fittingly received in said first and second open ends, respectively, said pistons having opposed closed ends within said barrel, said barrel having at least one first opening for transfer of fluid into said barrel as the said interior ends of said pistons are moved apart with the space formed therebetween in registry with said first opening and at least one second opening spaced apart from said first opening along said axis of said barrel for transfer of said fluid out of said barrel when said interior ends are moved toward each other when the space therebetween is in registry with said second opening, said interior ends being shaped for fitting each other for expelling substantially all fluid therebetween, said barrel including a third opening therein for transfer of another fluid into said barrel, first and second reservoirs for holding at least a first and second fluid, respectively, connecting with said first and third opening, respectively for delivery of fluid therethrough and at least one chamber connected with said at least one second opening for receiving fluid therethrough, said reservoirs and barrel being of a molded synthetic resin forming a module, whereby appropriate scheduling of the positioning of said pistons in said barrel makes it possible to draw a selected quantity of said first fluid into said barrel and to transfer same into said chamber and to draw a selected quantity of said second fluid into said barrel and to transfer same into said chamber.

2. The fluid-transfer system of claim 1, further including a plurality of entrance openings and a plurality of exit openings, said first and second pistons being adapted to selectively draw fluid through selected entrance openings and to selectively expel said fluid into selected exit openings.

3. The fluid-transfer system of claim 1, wherein reservoirs are each connected through one of said entrance openings to said barrel and wherein a plurality of said reservoirs are interconnected for receiving fluid from each other on introduction of fluid into any of same.

4. The fluid-transfer system of claim 1, wherein said module is disposable.

5. The fluid-transfer system of claim 1, wherein said resin is resistant to wetting by water and each of said openings connecting with said reservoirs is tapered so as to cause the lower meniscus of an aqueous fluid in a reservoir to withdraw from said opening.

6. The fluid-transfer system of claim 1, wherein said system includes means for access to said chamber for bringing a substance-specific electrode into contact with fluid in same.

7. The fluid-transfer system of claim 1, wherein the exterior of said pistons and the interior of said barrel are correspondingly threaded for minimization of flow of fluid between said barrel and said pistons.

8. The fluid-transfer system as claimed in claim 1, wherein the exterior of said barrel includes bellow means for sealing the coupling between said pistons and said barrel.

9. The fluid-transfer system of claim 1 further comprising motor-drives for positioning said pistons.

10. The fluid-transfer system as claimed in claim 9, wherein said motor-drives are operated under the control of a computer-controller.

11. The fluid-transfer system of claim 1, wherein said offset between said first, second and third openings is great enough to prevent flow of fluid from said barrel into said chamber during the drawing of a measured quantity of a fluid from a reservoir into said barrel.

12. The fluid-transfer system of claim 11, wherein said chamber has opposing faces and is transparent at least in those areas suitable for transmission of light therethrough.

13. The fluid-transfer system of claim 12, further comprising light-emitting means and light-sensing and signal- transmitting means disposed and connected for transmitting light through said at least one chamber, receiving and sensing the light transmitted through said chamber and signaling said computer concerning said light.

14. The fluid-transfer system of claim 1, wherein the positioning of said first and second pistons in said barrel is controlled by a computer.

15. The fluid-transfer system of claim 14, wherein said computer identifies the procedures, timing and sequence of the fluid transfer process in accordance with a computer program which corresponds to the pattern of reservoirs and openings of said barrel of said module.

16. The fluid-transfer system of claim 15, further comprising programmable computer means, controller means and drive means connectable with said first and second pistons for moving same to carry out transfer of selected fluids in controlled quantities from said reservoirs to said at least one chamber in accordance with said computer program.

17. The fluid-transfer system as described in claim 1, further comprising sealing means disposed for preventing flow of fluid between said pistons and said barrel.

18. The fluid-transfer system as described in claim 17, wherein said sealing means is a washer at the end of a piston.

19. The fluid-transfer system as described in claim 17, wherein said sealing means is an insoluble grease disposed between the cylindrical surface of said pistons and the interior surface of said barrel.

20. A fluid-transfer system as claimed in claim 1, wherein said first and second openings are connectable with first and second fluid passages.

21. The fluid-transfer system of claim 20, further comprising valve means for closing an opening and means for selectively opening said valve means.

22. The fluid-transfer system as claimed in claim 21, wherein said value means includes a valve covering an opening and a first magnet mounted on said valve, said first piston including a second magnet of like polarity to said first magnet.

23. The fluid transfer system as claimed in claim 21, wherein said valve means is defined as the surface of said pistons.

* * * * *